United States Patent [19]

Simoglou

[11] 4,370,818

[45] Feb. 1, 1983

[54] PROTECTIVE FOOTWEAR

[76] Inventor: Arthur Simoglou, 2014 Plant Ave., Redondo Beach, Calif. 90278

[21] Appl. No.: 216,690

[22] Filed: Dec. 15, 1980

[51] Int. Cl.[3] ..... A43B 3/24; A43B 23/26

[52] U.S. Cl. ..... 36/100; 36/54; 36/110

[58] Field of Search ..... 36/54, 50, 83, 100, 36/110, 45, 71 R

[56] References Cited

U.S. PATENT DOCUMENTS

| | | | |
|---|---|---|---|
| 2,334,133 | 11/1943 | Shields | 36/54 |
| 2,346,415 | 4/1944 | Clein et al. | 36/54 |
| 3,545,107 | 12/1970 | Cinquegrana et al. | 36/71 R |
| 4,126,951 | 11/1978 | Antonious | 36/54 |
| 4,169,324 | 10/1979 | Gibbs | 36/83 |

*Primary Examiner*—Patrick D. Lawson

*Attorney, Agent, or Firm*—Auslander, Thomas & Morrison

[57] ABSTRACT

A tongueless shoe includes a deep U-shaped opening forward of a foot-receiving opening for permitting the insertion therein of a heavily bandaged or protected foot. A removable tongue is attachable to bridge the U-shaped opening. A cushioning insert portion may be employed similar to the sock for protecting the foot when the sock-enclosed foot is worn inside the shoe portion. When the cushioning insert portion is employed, the tongue is removed. The insert portion is secured in place in the shoe portion by fastening means on a collar surrounding the foot-receiving openings of the insert portion and the shoe portion. Closure means such as straps or laces close the U-shaped opening over the foot.

13 Claims, 6 Drawing Figures

FIG. 1
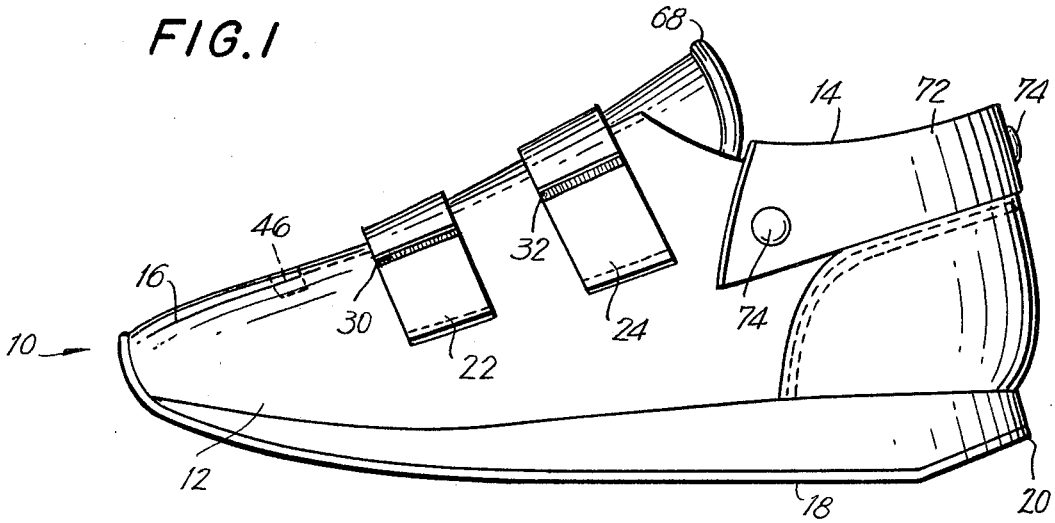
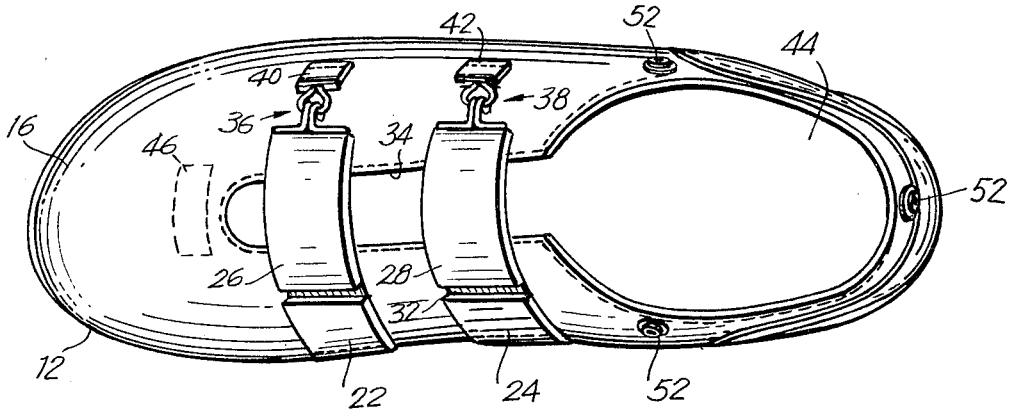
FIG. 2
FIG. 3
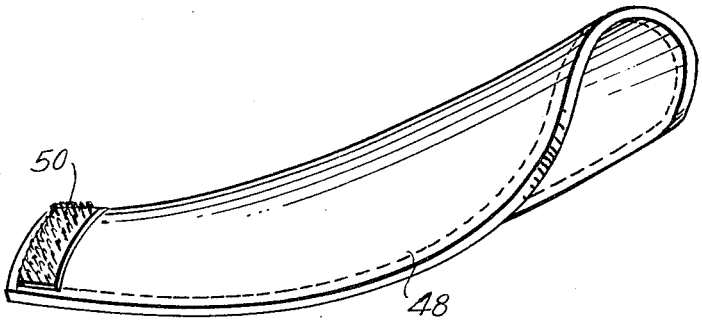

PROTECTIVE FOOTWEAR

BACKGROUND OF THE INVENTION

The present invention relates to footwear and more specifically to footwear especially adapted for use with feet requiring special protection such as those which are swollen, wounded, sensitive or tender.

Numerous foot problems interfere with comfort and the ability to walk. Such problems include circulatory problems, hypersensitive and/or disease damage problems such as from rheumatoid arthritis or degenerative arthritis, skin disease problems, ulcers, lack of sensation in the feet, poor or restricted blood circulation, flat feet and heavily bandaged feet.

The general idea of protecting feet employing foot protectors to be worn within a shoe is disclosed in a number of U.S. patents including, for example, U.S. Pat. Nos. 2,798,311; 3,562,818; 2,391,165; 3,013,564; 3,130,566 and U.S. Pat. No. 126,450.

Especially in the case of damaged feet which initially require heavy bandaging and later require less bulky protection, it has been necessary to provide two or more different shoe sizes and/or types to accommodate the progress of recovery.

OBJECTS AND SUMMARY OF THE INVENTION

Accordingly, it an object of the invention to provide protective footwear which overcomes the above described drawbacks.

It is a further object of the invention to provide protective footwear having an outer shoe-type portion adapted for receiving a heavily protected foot. The foot may be protected by an insert portion which is attached to the shoe portion by a collar. Alternatively, in the absence of the protective insert portion, a detachable tongue may be provided for user comfort.

According to an aspect of the invention there is provided a protective footwear comprising a shoe portion having an upper, a sole and a foot-receiving opening, the foot-receiving opening including an elongate opening forward of the foot-receiving opening adapted for permitting easy entry of a foot into the shoe portion, a foot-protecting insert portion effective to encase a foot in a protective layer, the shoe portion being adapted for receiving a foot encased in the insert portion, first fastening means adjacent a portion of the foot-receiving opening, and second fastening means complementary to the first fastening means and effective for removable attachment of the insert portion in the shoe portion.

According to a feature of the invention there is provided a system for protecting a foot having varying requirements for protection comprising a shoe portion having a foot-receiving opening which includes a U-shaped opening, the shoe portion having sufficient capacity for containing a bandaged foot, a removable tongue attachable inside the U-shaped opening for use with a bandaged foot, an insert portion of resilient material adapted to substantially completely encase an unbandaged foot, the shoe portion having sufficient capacity for containing the foot encased in the insert portion when the removable tongue is removed and means for drawing opposed edges of the U-shaped opening together.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 shows a side view of one embodiment of protective footwear according to the invention.

FIG. 2 shows a top view of a shoe portion of FIG. 1.

FIG. 3 shows a perspective view of a removable tongue usable with the shoe portion of FIG. 2.

DETAILED DESCRIPTION OF THE PREFERRED EMBODIMENT

Figure 4:
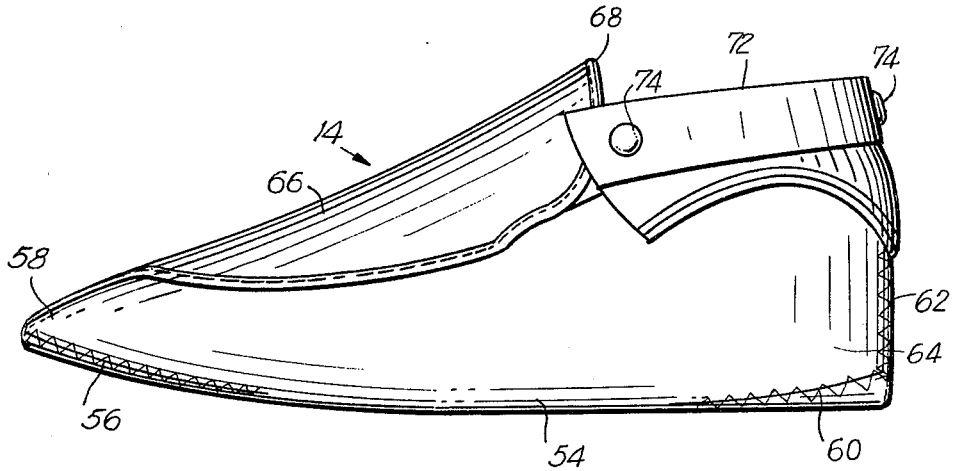
FIG. 4 is a side view of an insert portion of FIG. 1 with its attachment collar turned up.

Referring now to FIG. 1, there is shown, generally at 10 an embodiment of protective footwear. An outer or shoe portion 12 encloses an inner or insert portion 14 to be more fully described hereinafter.

Shoe portion 12 includes an upper 16 and a sole 18. Sole 18 may have a ramp portion 20 at the heel thereof for aiding the walking ability of a wearer having limited agility.

Upper 16 may be of any convenient material such as fabric or leather.

Referring now also to FIG. 2, a pair of tabs 22 and 24 are affixed to upper 16 by any convenient means such as, for example, by stitching. Tabs 22 and 24 are connected to straps 26 and 28 by elastic strips 30 and 32.

As best seen in FIG. 2, straps 26 and 28 extend over a tongueless deep U-shaped opening 34 and include fastening means at their distal ends. Any convenient fastening means may be employed such as, for example, snap fasteners, Velcro-type strips (neither of which are shown) or hooks and eyes 36 and 38 which are fastenable to tabs 40 and 42 attached to upper 16 by any convenient means such as by sewing.

A foot-receiving opening 44 provides entry for a foot into upper 12.

It should be noted that upper 12, as seen in FIG. 2 with insert portion 14 removed does not have a tongue.

The toe of shoe portion 12 is preferably formed with an oblique profile for improved user comfort. In order to permit comfortable use of shoe portion 12 without requiring the use of insert portion 14, a strip of Velcro-type material may be attached inside upper 16 beyond the forward end of U-shaped opening 34 as shown in dashed outline at 46 in FIG. 2. Either the loop portion or the hook portion may be employed at 46, but preferably the loop portion should be used.

Referring now to FIG. 3, a separable tongue 48 includes a Velcro strip 50 at one end thereof. The Velcro strip 50 is of a type complementary to that employed at location 46 inside upper 16. Tongue 48 may be temporarily installed in upper 16 by fastening Velcro strips 50 and 46 together.

Fastening means 52 of any convenient type are provided about the perimeter of foot-receiving opening 44. Fastening means 52 may be of any convenient type such as, for example, a part of a zipper, a Velcro strip (neither of which is shown) or the male portions of snap fasteners.

Figure 5:
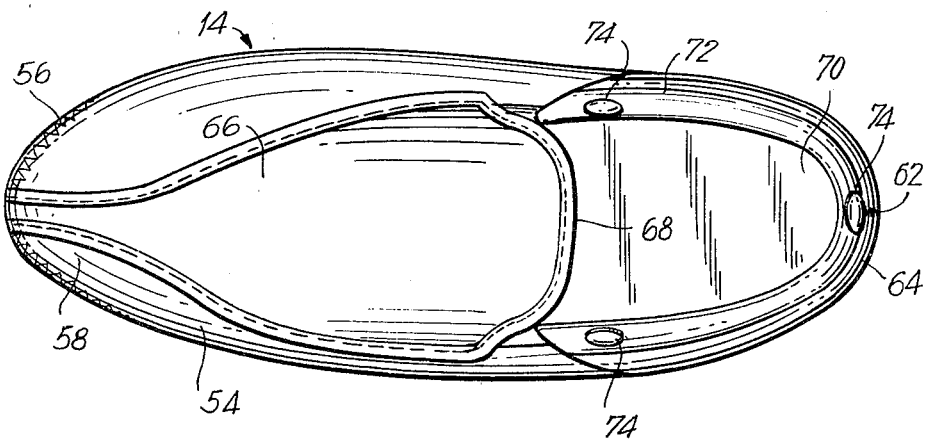
FIG. 5 is a top view of an insert portion with its attachment collar turned down.

Referring now to FIGS. 4 and 5, insert portion 14 is shown in greater detail. As shown, insert portion 14 encompasses the entire foot of the wearer with a resilient protective layer preferably of polyurethane foam which may be ¼ inch thick. A lower portion 54, may be formed of a flat foam sheet to conform to a foot by a seam 56 at the toe 58 and by additional seams 60 and 62 at a heel 64. Toe 58 may be tapered as shown for user comfort.

A shapeable layer may be laminated to the bottom of lower portion 54. Layer may be of any suitable material which can be thermally or otherwise preshaped to a users foot to accomplish one or more of arch support, heel support and metatorsal support. Satisfactory materials for shapeable layer are sold under trademarks such as Plastizote and Evazote.

Insert portion 14 may be a permanent or a throw-away item. For example, insert portion 14 may be made of gauze-type material backed with foam which, if it becomes stained or soiled can be discarded and replaced by a new insert portion 14.

Alternatively, insert portion 14 may be formed of materials such as fabrics, either woven or non-woven, either alone or laminated to a foam sheet that is washable and reuseable but which has qualities of permeability and cushioning which are conducive to foot comfort.

A layer of sheepskin including lanolin may be used as an inner liner in insert portion 14 or, alternatively, insert portion 14 may be formed of sheepskin. It is believed that sheepskin will help comfort, warm and mend ulcerated feet. Sheepskin is now used on long-term bed patients to alleviate bedsores.

An upper portion 66 overlays the top of lower portion 54 and is affixed to the perimeter thereof by any convenient means such as by cementing or by stitching to close toe 58 and to provide a protective cover for the upper portion of the wear's foot. The rear 68 of upper portion 66 is left free to provide easy entry for the wearer's foot into insert portion 14. A foot receiving opening 70 receives the wearer's foot.

A collar 72, shown folded upward in FIG. 4 and folded down in FIGS. 1 and 5, is disposed about the perimeter of foot-receiving opening 70 and is affixed to lower portion 54 by any convenient means such as, for example, by cementing, vulcanizing or stitching.

Fastening means of a type complementary to fastening means 52 on upper 16 (FIG. 2) are disposed on collar 72 for engagement with the complementary means on upper 16. Although the exact type of fastening means is not considered important, snap fasteners 74 are illustrated for concreteness of description.

In order to use the invention, the wearer may don insert portion 14 which may be worn indoors as slippers. For use outdoors, the feet encased in insert portions 14 may be then inserted through foot-receiving opening 44 of shoe portion 12 and hook and eye portions 36 and 38 may be engaged to fasten shoe portion 12 over insert portion 14. Straps 26 and 28 may, of course, include conventional length-adjusting means so that the same size shoe portion 12 may accommodate several foot sizes or conditions.

When the foot clad in insert portion 14 is inserted into shoe portion 12, collar 72 is folded down into the condition shown in FIG. 1 and snap fasteners 74 are engaged with complementary snap fasteners 52.

When the foot is heavily bandaged or when insert portion 14 is otherwise not required, tongue 48 (FIG. 3) may be affixed in upper 16 for use without insert portion 14.

The embodiment of the invention thus far described constitutes a system which may be employed for foot care after accident or surgical procedure. That is, a foot that requires heavy bandaging and other protection as a consequence of such condition, may employ a shoe portion 12 with tongue 48. As the need for heavy bandaging is reduced, the same shoe portion may be employed with insert portion 14 providing the needed protection for the foot. In order to permit such conversion, it is only necessary to remove tongue 48.

Figure 6:
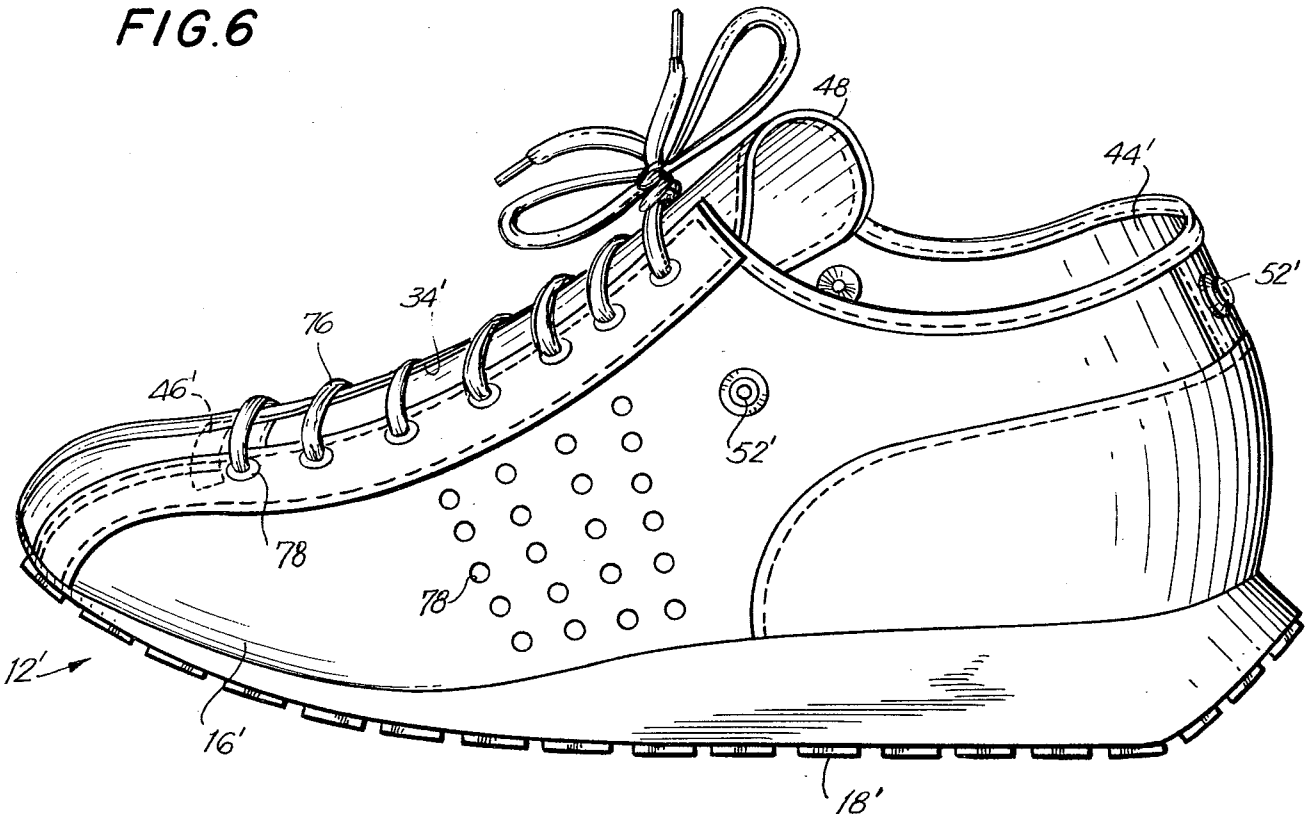
FIG. 6 shows a shoe portion of an item of protective footwear according to a second embodiment of the invention employing a lace and eyelets for closing the front portion thereof and including a removable tongue installed for use without a protective insert portion.

Referring now to FIG. 6, there is shown a further embodiment of the invention including a shoe portion 12' having a removable tongue 48. Instead of using straps as in previous embodiments, shoe portion 12' employs a shoelace 76 laced through eyelets 78 for closing U-shaped opening 34'. Fastening means 52' surround foot-receiving opening 44'.

Ventilating perforations 78 may optionally be employed in upper 16'.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Protective footwear comprising:

a shoe portion having an upper, a sole and a foot-receiving opening;

said foot-receiving opening including an elongate U-shaped opening forward of said foot-receiving opening adapted for permitting easy entry of a foot into said shoe portion;

a foot-protecting insert portion effective to encase a foot in a resilient protective layer;

said shoe portion being adapted for receiving a foot encased in said insert portion;

first fastening means adjacent a portion of said foot-receiving opening; and second fastening means complementary to said first fastening means and effective for removable attachment of said insert portion in said shoe portion;

said second fastening means including a collar on said insert portion; said collar being foldable over a perimeter of said foot receiving opening to contact an outside surface of said upper and being effective to bring said first and second fastening means into interengageable positions.

2. Protective footwear according to claim 1, wherein said first and second fastening means include a plurality of interengageable snap fasteners.

3. Protective footwear according to claim 1, further comprising a tongue and means for temporary attachment of said tongue to said shoe portion.

4. Protective footwear according to claim 1, further comprising means for drawing opposed sides of said elongated opening toward each other.

5. Protective footwear according to claim 4, wherein said means for drawing includes resilient portions.

6. Protective footwear according to claim 4, wherein said means for drawing includes at least one strap affixed to said upper at a first side of said elongate opening and having connecting means at a distal end thereof attachable to said upper at a second side of said elongate opening.

7. Protective footwear according to claim 4, wherein said means for drawing includes a lace and plurality of eyelets adjacent opposed sides of said elongate openings.

8. Protective footwear according to claim 1 wherein said insert portion includes a shapeable layer along a bottom thereof, said shapeable layer being adapted for preshaping to a users foot for support of a portion thereof.

9. Protective footwear according to claim 1 wherein said insert portion is adapted for washing and re-use.

10. Protective footwear according to claim 1 wherein said insert portion includes sheepskin.

11. A system for protecting a foot having varying requirements for protection comprising:

a shoe portion having a foot-receiving opening which includes a U-shaped opening, said shoe portion having sufficient capacity for containing a bandaged foot;

an insert portion of resilient material adapted to substantially completely encase an unbandaged foot;

said shoe portion having sufficient capacity for containing said foot encased in said insert portion;

means for drawing opposed edges of said U-shaped opening together; means for attaching said insert portion to a perimeter of said foot-receiving opening; said means for attaching said insert portion including a collar on said insert portion; said collar extendable above a perimeter of said foot-receiving opening and foldable down over an outside surface of said upper; and aligned interengageable means on facing portions of said upper and said collar.

12. A system for protecting a foot having varying requirements for protection according to claim 11 wherein said interengageable means includes a plurality of snap fasteners.

13. The invention of claim 11 including a removable tongue attachable inside said U-shaped opening.

* * * * *